US005662777A

United States Patent [19]

Schiel et al.

[11] Patent Number: 5,662,777

[45] Date of Patent: Sep. 2, 1997

[54] SHOE PRESS ROLL FOR PRESS DEVICE FOR A PAPER MACHINE

[75] Inventors: Christian Schiel, Heidenheim; Ulrich Wieland, Berg, both of Germany

[73] Assignee: Voith Sulzer Papiermaschinen GmbH, Germany

[21] Appl. No.: 628,470

[22] Filed: Apr. 5, 1996

[30] Foreign Application Priority Data

Apr. 15, 1995 [DE] Germany ..... 195 14 142.3

[51] Int. Cl.[6] ..... D21F 3/02

[52] U.S. Cl. ..... 162/358.3; 162/272; 162/361; 492/7

[58] Field of Search ..... 162/358.3, 272, 162/361; 492/7

[56] References Cited

U.S. PATENT DOCUMENTS

| | | | |
|---|---|---|---|
| 4,917,768 | 4/1990 | Ilmarinen | 162/358.3 |
| 5,223,100 | 6/1993 | Schiel et al. | 162/358.3 |
| 5,507,916 | 4/1996 | Schiel | 162/358.3 |

FOREIGN PATENT DOCUMENTS

| | | |
|---|---|---|
| 4402595 | 7/1994 | Germany . |
| 4 40 25 95 A 1 | 7/1994 | Germany . |

OTHER PUBLICATIONS

European Search Report mailed 30 Aug. 1996.

*Primary Examiner*—Karen M. Hastings

*Attorney, Agent, or Firm*—Ostrolenk, Faber, Gerb & Soffen, LLP

[57] ABSTRACT

A shoe press roll for a press device for a paper machine. The roll includes a stationary support. A press shoe supported on the support in a radially displaceable manner. A plurality of hydraulic elements in the support and arrayed along the length of the press shoe across the width of the web to urge the press shoe against the backing roll. A plurality of return springs connected between the support and the leading and trailing sides of the press shoe, the springs being located outside the hydraulic elements at the press shoe. The return springs are compression springs fastened by struts on the lateral sides of the press shoe which involves a simple mounting for enabling separable attachment of the tie rods of the spring and the lateral sides of the press shoe.

23 Claims, 3 Drawing Sheets

SHOE PRESS ROLL FOR PRESS DEVICE FOR A PAPER MACHINE

BACKGROUND OF THE INVENTION

The present invention relates to a press device for a paper machine, or the like, having a shoe press roll. A shoe press "roll" comprises a stationary support member on which a press shoe is supported for radial displacement toward and away from, and which can be pressed hydraulically against a backing roll to define a web dewatering press nip between the rolls. More particularly, the invention concerns return means for urging the press shoe back from the backing roll.

Such a press device is known from Federal Republic of Germany Patent Publication 44 02 595 A1. The known press device is a so called long nip press device having a shoe press roll which can be pressed hydraulically against a backing roll. The shoe press roll includes a press shoe which is pressed by hydraulic means against the backing roll via a pressure chamber which extends in the length direction of the press shoe, i.e., across the width of the press device. The pressure chamber is formed by the press shoe at the radial outside of the chamber and a shoe bed beneath the shoe which rests on a stationary support member of the shoe press roll. A flexible material press jacket or shell, which is hydrodynamically lubricated in order to minimize its friction on the press shoe, extends in known manner over the press shoe and passes through the press nip.

To withdraw the press shoe into its starting position upon the absence of pressure in the pressure space and also to prevent the press shoe from falling down when the shoe press roll is arranged on top of the backing element, there are return elements which are acted on by springs and which act on the press shoe via pulleys. These are arranged within the pressure chamber.

This provides the flattest possible construction so that the dimensions of the press shoe unit, and particularly of the shoe bed, in the radial direction of the roll, need not be excessively enlarged.

A similar press device is known from Federal Republic of Germany Publication 41 13 623 C1 (also U.S. Pat. No. 5,223,100). Spring elements which counteract the pressure prevailing in the pressure chamber are also arranged within the pressure chamber. When the pressure chamber is almost without pressure, the spring elements return the press shoe in the direction toward the shoe bed.

One disadvantage of the above noted structural units is that corresponding lead throughs are necessary in the shoe bed. These require additional seals. Furthermore, holes are necessary in the support member, which correspondingly weakens it.

Both known press devices have the disadvantage that mounting of the press shoe together with the return devices is relatively expensive and the press shoe can be replaced only at great expense. Furthermore, even when the return elements are developed as spring elements which cooperate with cables conducted over pulleys, the pressure chamber is noticeably enlarged which correspondingly weakens the cross section of the support member. This promotes greater sagging of the shoe press roll, which may require compensation by additional measures, such as strengthening the support member.

Another disadvantage of the known press devices results from the press shoe being hydraulically acted upon only via a single pressure chamber which extends in the lengthwise direction of the press shoe across the width of the press device. Thus, the application force is the same over the entire width of the roll. However, in such press devices, the two edges of the paper web which travels through the press device may be more strongly dewatered than other regions across the paper web, particularly when a paper web of somewhat smaller than normal width is produced. In this case, the pressing force in the region of the edges of the web must be reduced.

Federal Republic of Germany Application 43 19 323 A1, discloses applying the press shoe to the press jacket, not using a single lengthwise pressure chamber across the width of the press roll but, instead, using a plurality of hydraulic cylinder/piston units arranged in a row in the lengthwise direction of the press shoe. This enables the application pressure of the press shoe in its lengthwise direction to be adapted to required circumstances.

Spring elements are arranged within the cylinder/piston units in order to assure pressing of the corresponding cylinder/piston unit against the press shoe even when the pressure chamber is without pressure. Even when there is not yet sufficient pressure in the pressure chamber, clean application of the sealing surfaces of the cylinder/piston unit against the press shoe should be assured, so that lateral emergence of hydraulic oil is avoided. The cylinder/piston units are tiltable by a certain amount to make their application against the press shoe possible.

Although the known press device permits a finer adjustment of the pressing pressure along the length of the press shoe across the width of the web, no measures are taken to assure the return of the press shoe in the direction toward the support member in opposition to the action of the spring force. Only limiting elements limit the maximum stroke of the cylinder/piston units. However, this is frequently insufficient, particularly if the shoe press roll is arranged on the top or above the backing roll, particularly upon the starting up of the paper machine and upon maintenance and adjustment work.

A press device of similar type is known from the publication EP 0 345 501 B1. However, it has the same disadvantages as the above press device.

SUMMARY OF THE INVENTION

Thus, the object of the invention is to improve a press device of the aforementioned type to enable simple mounting and removal of the press shoe and so that the least possible weakening of the support member is caused by the return means.

According to the invention, in a press device of the aforementioned type, a plurality of hydraulic elements is provided in the lengthwise direction of the press shoe across the web in order to urge the press shoe against the backing roll. Return means act on the support member and the press shoe outside the hydraulic elements. The pressure of the press shoe against the backing roll in the lengthwise direction of the press shoe can be adapted to circumstances. For instance, particularly in the end regions, the press pressure must be reduced for narrower than normal paper webs.

Furthermore, because the return means act on the support member and the press shoe outside the hydraulic elements, the construction of the return means is simplified, and mounting and removal of the press shoe are considerably facilitated. At the same time, weakening of the support member is avoided because the return elements can act laterally alongside the press shoe, enabling the pressure chambers of the hydraulic elements to have minimal length in the radial direction. As a result, weakening of the cross section of the support member is completely avoided, particularly in this important region below the hydraulic elements.

In accordance with an advantageous further development of the invention, the return means comprise spring elements which are arranged substantially perpendicular to the general plane or circumferential path of the press shoe and parallel to the hydraulic elements.

Although the return means in principle could also be constructed as hydraulic elements or in some other manner, spring elements are preferred because their use simplifies the construction of the return means.

In a further development of the invention, the spring elements are tiltable with respect to the press shoe. This facilitates mounting and removal of the press shoe because to loosen the press shoe from the spring elements, the spring elements need merely be tilted slightly outward, so that, after the loosening of corresponding anchoring elements, the press shoe can be easily removed.

The return means can have a particularly simple construction in an advantageous further development of the invention, where the spring elements include tie rods that extend in the axial direction of the spring elements. The ends of the tie rods facing the press shoe can be connected to the press shoe via respective swivel joints.

As a result, it is not necessary to tilt the entire spring elements in order to mount or remove the press shoe. After loosening the corresponding anchoring elements, it is instead necessary to merely swing the swivel joint of the rod outward in order to permit removal of the press shoe.

In another development of the invention, the spring elements are developed as coil springs, which have ends that face away from the press shoe. Those ends are held in receivers which are connected to the press shoe via struts which are developed as central tie rods. This provides a particularly simple construction of the spring elements.

In an additional further development of the invention, tensioning elements tension the spring elements upon mounting or replacement of the press shoe. As another feature of the invention, the tensioning elements act eccentrically on the supports or receivers of the coil springs, which are located at an end of the coil springs.

These measures enable simple mounting and removal of the press shoe without additional aids. Further, eccentric action of the tensioning elements on the receivers of the coil springs enable tilting of the tensioning elements upon the mounting.

As an additional further development of the invention, the tie rods can be connected by quick disconnect elements to the side surfaces of the press shoe. In each case, the connection may comprise an element protruding laterally from the press shoe which can be suspended in an extension of the tie rod.

In this way, particularly rapid installation and removal of the press shoe is made possible, since only the tensioning elements need be suitably pretensioned. Then the quick disconnect elements can be either attached for mounting the press shoe or removed for removing the press shoe.

In a further embodiment of the invention, lateral guide ledges take up transverse forces that act on the press shoe in the direction of travel of the web. The guide ledges support the press shoe. They comprise individual guide pieces which are arranged spaced from each other in the lengthwise direction of the press shoe across the web.

This makes it possible to provide a "floating" arrangement of the press shoe relative to the hydraulic elements, which permits a certain lateral evasion and tilting of the press shoe relative to the support member with a sufficient lateral guidance for taking up of any transverse forces. On the other hand, because the guide ledges are comprised of individual guide pieces, which are spaced from each other in the lengthwise direction of the press shoe, there are interruptions in the guide ledges in the region of the return means. This provides a simplified construction and creates little hindrance to mounting or removal of the press shoe.

In a preferred further development of the invention, at least one hydraulic element comprises a pressure chamber which can be acted on by hydraulic pressure. It is formed in a cylindrical recess between the support member and the press shoe wherein the recess is preferably in the support member. The recess is limited laterally by a first sleeve which is guided for axial displacement and tilting in the cylindrical recess.

Since the hydraulic pressure prevailing within the pressure chamber does not act on the press shoe via a piston or a piston rod, but instead acts directly on the shoe, this avoids both mechanical wear between the hydraulic element and the press shoe and canting of the guidance of the sleeve in the cylindrical recess. This takes up horizontal relative movements between the hydraulic element and the press shoe. Those movements are caused, for instance, by thermal expansions or by changes in load on the press shoe.

The first sleeve can be guided directly in the cylindrical recess. As an alternative, it can, however, also cooperate telescopically with a second sleeve.

In accordance with another embodiment of the invention, the first sleeve is guided by means of a packing to be axially movable and tiltable with respect to a second sleeve held in the cylindrical recess in the support member.

In this way, precision machining of the cylindrical recess within the support member is not needed. Instead, it is sufficient if a suitable sleeve is provided in the cylindrical recess in the support member. The sleeve is preferably tightly secured by screws to the end surface of the cylindrical hole in the support member.

As an additional further development of this embodiment, the first sleeve is arranged within the second sleeve, and the pressing means comprises a compression spring arranged within the first sleeve, preferably between an end surface of the cylindrical recess and a projection of the first sleeve. As an alternative, the second sleeve may be arranged within the first sleeve and the pressing means, comprising a compression spring, is preferably arranged between an outer projection of the second sleeve and an end surface of the cylindrical recess.

Both additional embodiments provide a simple construction of the hydraulic elements. They assure that when the hydraulic elements are without pressure or are practically without pressure, lateral emergence of hydraulic oil as a result of packings which rest only inadequately against the corresponding mating surfaces, is substantially avoided.

Furthermore, pressing means comprising a compression spring, and preferably a coil spring, provides a particularly simple construction. Instead of a single compression spring, several compression springs acting in parallel may be provided.

In principle, it is obvious that one sleeve which can move together with the press shoe within the cylindrical recess is sufficient. Instead, the first sleeve, as already mentioned, can also cooperate telescopically with a second sleeve which is arranged either radially within or outside the first sleeve. Furthermore, the pressing element, which is preferably developed as a coil spring, can be arranged either within the pressure space or outside the pressure space in the recess.

The recess is preferably developed as a cylindrical recess. However, instead of several such cylindrical recesses arranged one after the other, a groove can also be provided within the support member. The groove extends in the direction of the press shoe and several hydraulic elements are received in the groove.

It is obvious, furthermore, that the above mentioned features and the features of the invention explained below can be used not only in the combinations indicated in each case but also in other combinations or by themselves.

Further objects, advantages and features of the invention will become evident from the following description of preferred embodiments, read with reference to the drawings.

DETAILED DESCRIPTION OF THE INVENTION

Figure 1:
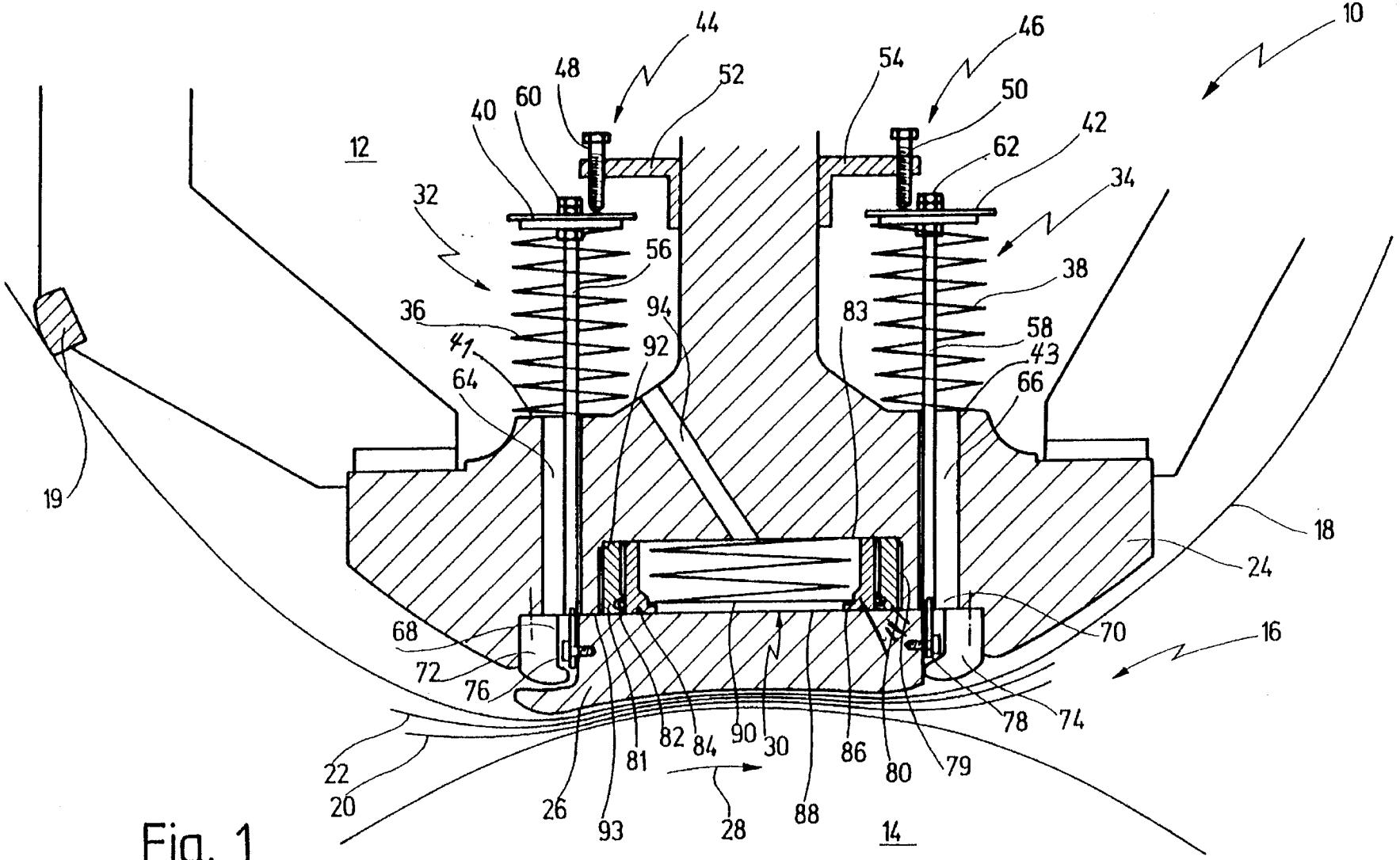
FIG. 1 is a cross section through a press device in accordance with the invention, showing only important parts of the shoe press roll and merely indicating the backing roll.

A press device 10 of the invention is shown in FIG. 1. The press device comprises a shoe press roll 12 having a press shoe 26 which can be pressed hydraulically against a backing roll 14. A flexible tubular press jacket 18 travels over the press roll past the backing roll. A long or extended press nip 16 is formed in the region between the press shoe 26 and the backing roll 14.

A dewatering felt belt 22 together with a paper web 20 which is to be dewatered is conducted through the press nip.

The shoe press roll 12 has a stationary support member 24 which includes a row of guide ledges or rails 19 arranged at circumferentially spaced intervals and over which the tube like press jacket 18 can be positioned outside the press nip 16. Generally, centrifugal force acting on the moving press jacket causes it to travel without contact with and at a small distance from the guide ledges 19.

The press shoe 26 has a concave cross section which is adapted to the shape of the backing roll 14. The shoe is correspondingly developed on its nip entrance side to assure a good development of a hydrodynamic lubrication wedge upon rotation of the press jacket 18 through the press nip 19 in the direction of travel 28 of the paper web 20.

Figure 2:
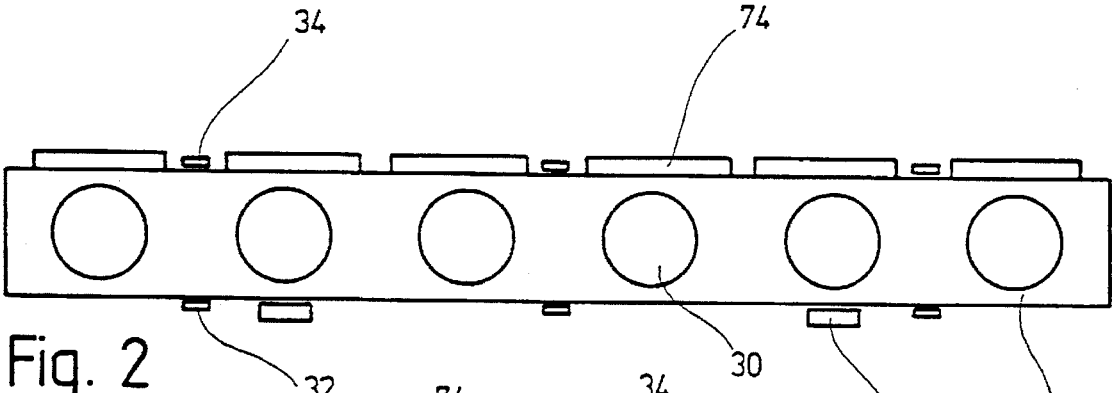
FIG. 2 is a plan view of a press shoe in accordance with the invention showing only the positions of the hydraulic elements, of the return means, and of the guide pieces.

For pressing the press shoe 26 against the backing roll 14, a plurality of hydraulic elements 30 are distributed over the length direction of the press shoe 26 across the width of the press device and of the web, as seen in FIG. 2.

FIG. 1 shows an arrangement in which the shoe press roll 12 is arranged above the backing roll 14. The invention can, of course, also be advantageously used with the reverse arrangement in which the shoe press roll is arranged at the bottom.

The support member 24 has a preferably cylindrically shaped recess 79 for each hydraulic element 30. Each hydraulic element can be acted on by hydraulic oil via a respective hydraulic channel 94 through the member 24. Instead of several cylindrical recesses 79, a continuous groove may be provided which receives several hydraulic elements.

In FIG. 1, a first radially inner (inner with respect to the element 30) sleeve 80 is sealed at its radially outer (outer with respect to the press roll 12) end by a packing ring 84 against the resting surface 93 of the press shoe 26. A radially outer second sleeve or cylinder 81 surrounds the inner sleeve 80. The second cylinder 81 is rigidly connected to the support member 24, for instance, by screws, not shown. On the end surface facing away from the press shoe 26, the cylinder 81 is sealed off by an O-ring 92 against the bottom or end surface 83 of the cylindrical recess 88. On its end facing the press shoe 26, the cylinder 81 is sealed off on the inner side by a packing ring 82 which acts radially against the inner sleeve 80.

The first inner sleeve 80 is pressed by pressing means 90, arranged as a coil spring within the first sleeve 80, against the internal resting surface 93 of the press shoe 26. The spring 90 rests on an annular land 86 on the first sleeve 80.

A pressure chamber 79 which can be acted on via the hydraulic channel is defined by the first inner sleeve 80 which cooperates with the second outer sleeve 81, the bottom end surface 83 of the cylindrical recess 88, and the resting surface 93 of the press shoe 26. Since the first sleeve 80 is open toward the resting surface 93 of the press shoe 26 and is merely sealed off with respect to that surface, mechanical wear between the hydraulic element and the press shoe 26 is avoided. Yet, horizontal relative movements between the hydraulic element 30 and the press shoe, which may be caused for instance by thermal expansions or by changes in load on the press shoe 26, are tolerated. Furthermore, canting in the guidance of the sleeves 80, 81 is avoided.

The pressing means 90 in the form of a spring assures that under all operating conditions and even if no hydraulic pressure is present in the hydraulic element 30, the inner sleeve 80 rests cleanly against the press shoe 26 so that lateral emergence of hydraulic oil is avoided. In FIG. 1, no hydraulic pressure is present, so that the press shoe 26 is pressed against the support member 24 under the action of the return means 32, 34, described below. When hydraulic pressure is present, the press shoe 26 lifts radially off the support member 24. It "floats" on the pressure cushion defined by the hydraulic element 30 and is guided laterally only by the guide ledges 74, which take up the transverse forces that occur during operation of the press device. The first inner sleeve 80 can tilt to a certain extent within the second outer sleeve 81 in order to be able to move correspondingly to the press shoe 26.

In the top lying arrangement shown in FIG. 1 and without additional measures, the press shoe 26 would easily drop downward upon stopping of the press device and upon mounting or adjustment work on the device, when merely a sufficiently large distance to the backing roll 14 is present. In order to prevent such dropping and to permit pull back of the press shoe 26 against the action of the spring 90, a plurality of return means 32, 34 are arrayed over the lengthwise direction of the press shoe 26 across the width of the web. Their arrangement is shown in FIGS. 1 and 2.

The return means 32, 34 are developed as spring elements 36, 38 which are in the form of coil springs which are placed along both sides of the press shoe 26 in the web travel direction. The ends 60, 62 of the two springs face away from the press shoe 26 and they rest against respective so called spring cups 40, 42. The centers of the spring cups 40, 42 are screwed to respective tie rods 56 and 58, which extend through the coil springs and through corresponding recesses 64, 66 in the support member 24 and down to the press shoe 26, where the rods are connected to the opposite leading and trailing outside side surfaces of the shoe. The spring elements are clamped between the spring cups 40 and 42 and the opposed resting surfaces 41 and 43 respectively on the support member 24. Lowering of the press shoe 26 correspondingly increases the tension of the spring elements 36, 38.

To facilitate mounting of the press shoe, tensioning elements 44, 46 are fastened on the central support member by holders 52, 54. The elements 44, 46 can be clamped by means of tensioning screws 48 and 50 respectively against the spring cups 40 and 42. The tensioning screws 48 and 50 act eccentrically on the spring cups 40 and 42 respectively, so that upon tightening of the tensioning screws 48 and 50, the coil springs 36 and 38, together with their spring cups 40 and 42 and also together with the tie rods 56 and 58 connected with them, are pressed outward from and away from the side surfaces of the press shoe 26 so that loosening and removal of the press shoe 26 upon the dismounting thereof is facilitated.

For this purpose, the recesses 64 and 66 in the support member 24 have a corresponding width so that tilting of the tie rods 56 and 58 toward the outside, in each case away from the press shoe 26, under the bias of the screws 46 and 48, is possible.

Figure 4:
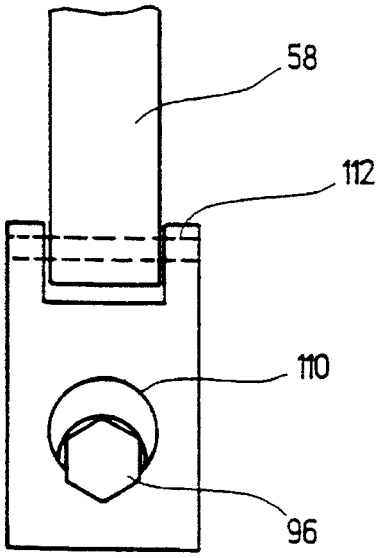
FIG. 4 is a side view of the connection shown in FIG. 3.
Figure 3:
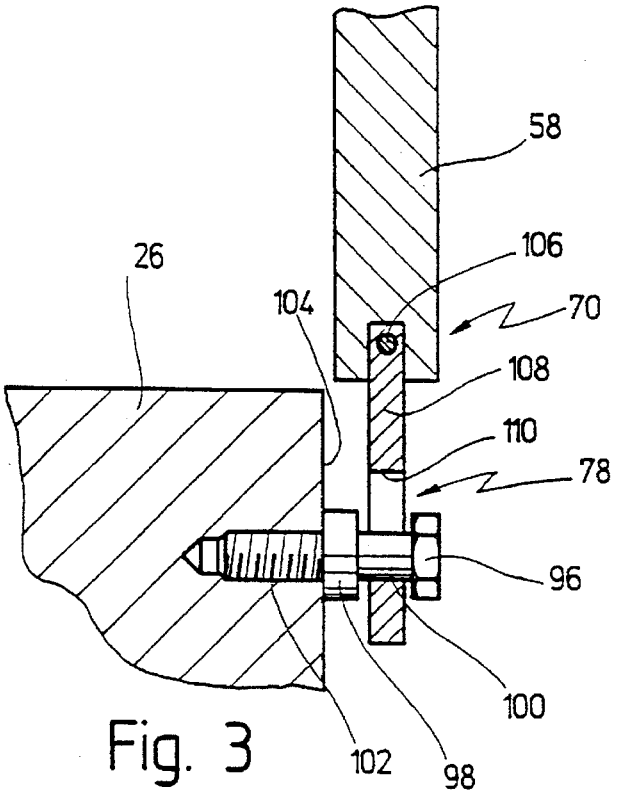
FIG. 3 is a cross-sectional view showing an enlarged portion of FIG. 1, specifically the construction of the swivel joint and of the quick disconnect element.

As shown in FIGS. 1, 3 and 4, the ends of the tie rods 56 and 58 facing the press shoe 26 are connected via swivel joints 68 and 70 with the press shoe 26.

In FIG. 3, a pin 106 passes through the end of the tie rod 58. The pin is held in corresponding holes 112 in a fork 108 so that the fork 108 is swingable with respect to the end of the tie rod 58.

The fork 108 is adapted to be fastened by a quick disconnect element 78 to the press shoe 26. The quick disconnect element 78 has a circular opening 110 in the fork 108 through which the head of a screw 96 can be passed. The screw 96 is threaded into a threaded hole 102 in the side surface 104 of the press shoe 26 and via a collar 98, the screw 96 presses against the side surface 104 of the press shoe 26. Between the head of the screw 96 and the collar 98, there is a neck 100 of reduced diameter. Therefore, when its head is aligned with the opening 110, the screw 96 can thus be introduced through the opening until the neck of the screw 100 comes into the region of the opening 110. If the clamping element of the coil spring is now released, then the press shoe 26 is pulled upward under the action of the coil spring, so that the neck 100 of the screw 96 is securely held in the opening 110 in the fork 108. In this way, an easily disconnectable, reliable connection is obtained between the fork 108 and the press shoe 26.

Figure 5:
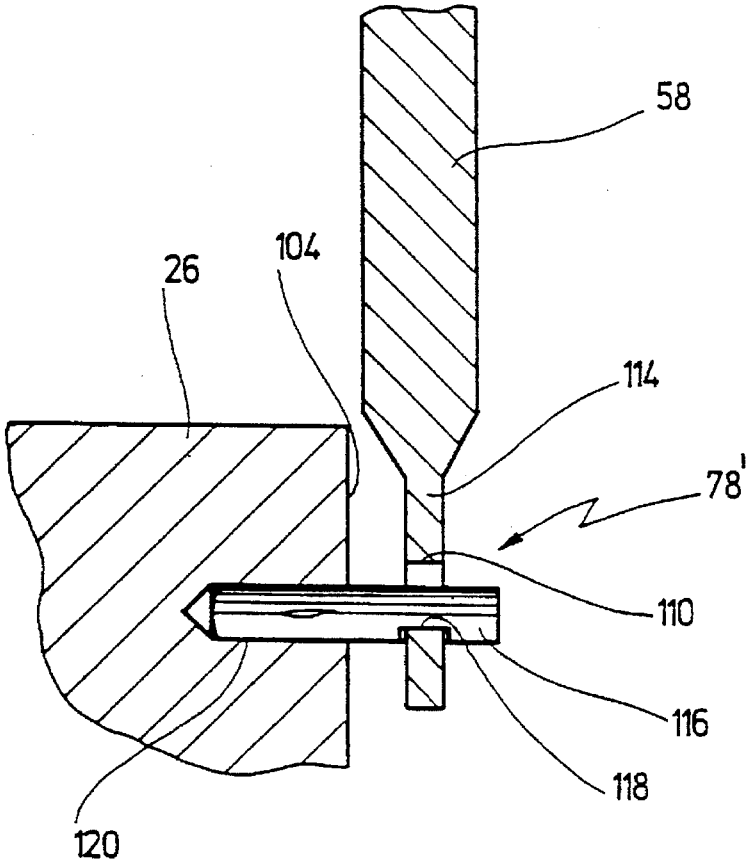
FIG. 5 shows an alternative embodiment of the connection of the spring element to the press shoe.

An alternative embodiment of the connection between the tie rod 58 and the press shoe 26 is shown in FIG. 5. In this case, the joint at the end of the tie rod 58 is dispensed with. Instead, an extension 114 of smaller thickness is welded on the end. The quick disconnect element 78' again has a circular opening 110' in the extension 114 through which a pin can now be inserted instead of a screw. The pin is hammered with a press fit into a hole 120 in the side surface 104 of the press shoe 26. The pin 116 has a groove 118 at its outer end, by which the extension 114 can be suspended in the opening 110'.

Further modifications of the possible connection between the struts of the return means and the press shoe are possible.

FIG. 2 shows the arrangement of the hydraulic elements 30 and of the return means 32 and 34 respectively over the length direction of the press shoe 26 across the machine width. A total of six hydraulic elements 30 are distributed at equal distances apart along the opposite sides of the press shoe 26 in the example shown. Between two adjacent hydraulic elements, the return means 32, 34 described above are arranged on both sides of the press shoe 26. FIG. 2 shows a total of six return means. If necessary, of course, a larger number of return means can be provided so that return means 32, 34 are provided between each two adjacent hydraulic elements 30 on both sides of the press shoe 26.

The coil springs 36 and 38 are dimensioned so that their spring force is sufficient to offset at least the force of the spring 90 and the weight of the press shoe 26 so as to prevent further emergence of the press shoe 26 from the shoe press roll 14 during mounting or maintenance procedures. If possible, the spring force of the coil springs 36, 38 should be made even somewhat stronger so that the press shoe 26 is pulled back with a certain force to the support member 24.

In FIG. 1, the return means 32, 34 and the press shoe 26 are shown in one plane, namely the plane of the drawing, in order to simplify the showing.

Similarly, the lateral guide ledges 72 and 74 in FIG. 1 are shown in elevation in FIG. 1. The laterally arranged guide ledges include individual guide pieces 74. They take up the transverse force on the press shoe acting in the direction of travel 28 of the web. The opposite guide pieces 72 merely guide the press shoe 26 on the opposite side. But, they need not take up large transverse forces. In order to permit easy mounting and removal of the press shoe 26, the guide ledges are interrupted along both sides of the press shoe 26 in the regions of the return means 32 and 34, producing individual guide pieces 72 and 74.

Figure 2A:
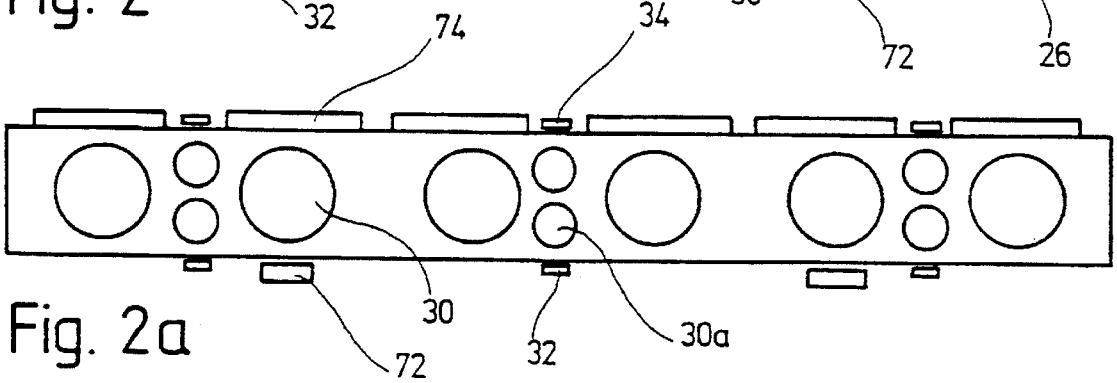
FIG. 2*a* shows a modification of the embodiment of FIG. 2.

In FIG. 2*a*, in addition to the relatively large hydraulic elements 30 which lie in a single row, smaller diameter hydraulic elements 30*a* which lie in two rows can be provided. Any desired number of them is possible. They can be larger or smaller than shown in FIG. 2*a*. They cooperate with the elements 30.

Figure 6:
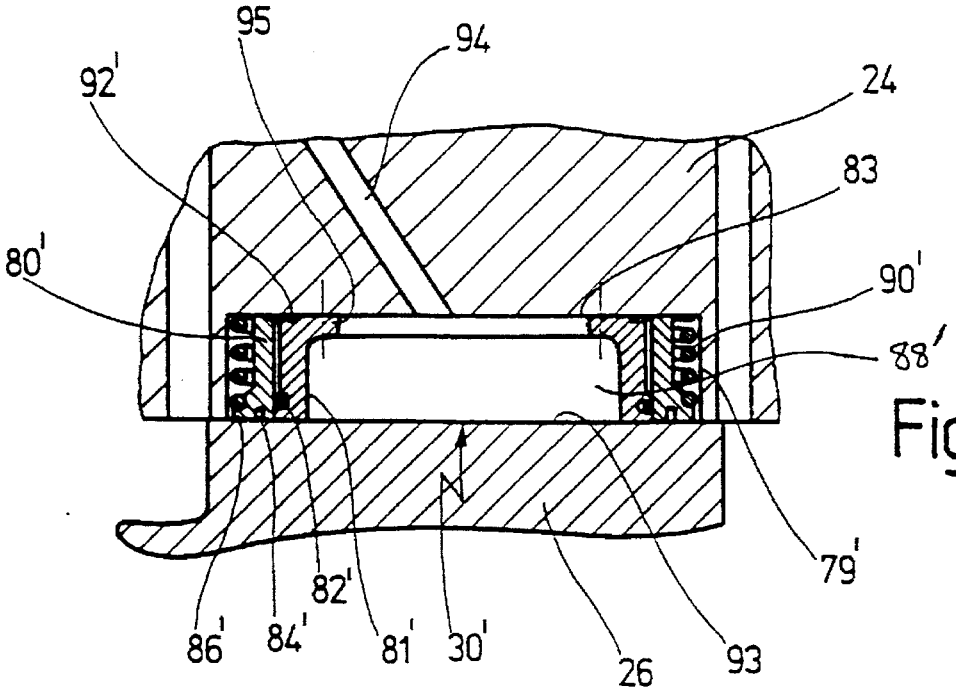
FIG. 6 shows an alternative construction of a hydraulic element in accordance with the invention.

FIG. 6 shows an alternative construction of a hydraulic element 30'. Parts which have been modified as compared with FIG. 1 are provided with corresponding reference numerals followed by a prime sign.

The hydraulic element 30' comprises a radially inner second sleeve 81' which is fixed in the cylindrical recess 79' of the support member 24 and can be acted on by hydraulic oil via the hydraulic channel 94. The inner second sleeve 81' is sealed off from the cylindrical recess 79' at the end surface 83 of the recess facing away from the press shoe 26 via an O-ring 92'. It is also sealed from the press shoe 26 on its end side facing the press shoe 26 via a packing 84'. The radially outer first sleeve 80' is pressed against the press shoe 26 by pressure means 90', in the form of a coil spring which rests on an outer annular land 86'. This forms a pressure chamber 88' which is defined by the end surface 83 of the cylindrical recess 79', the opposite resting surface 93 of the press shoe 26, and the two sleeves 80', 81'.

If the hydraulic element is now acted on by hydraulic oil, then the press shoe 26 moves, together with the outer first sleeve 80', in the direction toward the backing roll 14 while the inner second sleeve 81' remains in the recess 79' since it is fastened by grooves to the support member 24.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A shoe press roll for a press device of a paper machine, wherein the shoe press roll comprises:

a stationary support; a press jacket at the support;

a press shoe supported on the support for being pressed toward the press jacket and for pressing the press jacket toward a backing roll with which the shoe cooperates;

hydraulic elements at the support and acting on the shoe for pressing the shoe toward the backing roll, the hydraulic elements being arrayed along the length of the shoe across the web; each of the hydraulic elements comprising a recess located in the support on the side of the press shoe away from the backing roll for containing hydraulic pressure, means for transmitting hydraulic pressure to each recess;

return means connected between the support and the press shoe for pulling the shoe away from the backing roll, the return means being positioned and arranged to act on the press shoe and on the support member outside of and not within the hydraulic elements and outside of the recesses of the hydraulic elements.

2. The shoe press roll of claim 1, wherein the recess is formed in the support.

3. The shoe press roll of claim 1, wherein the hydraulic elements have a direction of extension and the press shoe has a length dimension around the shoe press roll;

the return means comprising spring elements oriented substantially perpendicular to the press shoe length dimension and parallel to the extension direction of the hydraulic elements.

4. A shoe press roll of claim 1, wherein the return means comprise spring elements connected between the press shoe and the support for biasing the shoe away from the backing roll.

5. The shoe press roll of claim 4, wherein the hydraulic elements have a direction of extension and the press shoe has a length dimension around the shoe press roll;

the spring elements being oriented substantially perpendicular to the press shoe length dimension and parallel to the extension direction of the hydraulic elements.

6. The shoe press roll of claim 5, wherein the spring elements are supported to the shoe so as to be tiltable with respect to their orientation as to the press shoe.

7. The shoe press roll of claim 4, wherein the spring elements are supported to the shoe so as to be tiltable with respect to their orientation as to the press shoe.

8. The shoe press roll of claim 4, further comprising tensioning elements for tensioning the spring elements.

9. The shoe press roll of claim 1, further comprising lateral guide ledges on the support for guiding the shoe for taking up transverse forces on the shoe acting in the circumferential direction of the press roll.

10. A press device for a paper machine comprising the shoe press roll of claim 1 and a backing roll positioned to cooperate with the shoe of the shoe press roll, so that when the shoe is urged toward the backing roll, a press nip is defined between the shoe and the backing roll.

11. A shoe press roll for a press device of a paper machine, wherein the shoe press roll comprises:

a stationary support; a press jacket at the support;

a press shoe supported on the support for being pressed toward the press jacket and for pressing the press jacket toward a backing roll with which the shoe cooperates;

hydraulic elements at the support and acting on the shoe for pressing the shoe toward the backing roll, the hydraulic elements being arrayed along the length of the shoe across the web;

return means connected between the support and the press shoe for pulling the shoe away from the backing roll, the return means being positioned and arranged to act on the press shoe and on the support member outside of and not within the hydraulic elements; the return means comprise spring elements connected between the press shoe and the support for biasing the shoe away from the backing roll;

tie rods extending in the axial direction of the spring elements and connected with the spring elements; a respective swivel joint between each of the tie rods and the press shoe.

12. The shoe press roll of claim 11, wherein each spring element comprises a coil spring; each coil spring having a remote end away from the press shoe;

a spring cup receiving the remote end of the coil spring; and the tie rod being connected with the spring cup for connecting the spring cup to the press shoe.

13. The shoe press roll of claim 12, further comprising tensioning elements for tensioning the spring elements; the tensioning elements acting on the cups of the coil springs at a location eccentric to the tie rods.

14. The shoe press roll of claim 11, further comprising tensioning elements for tensioning the spring elements.

15. The shoe press roll of claim 11, wherein the press shoe has sides toward the hydraulic elements and toward the backing roll and has side surfaces extending between the sides; quick disconnect elements at the side surfaces of the press shoe for connecting with the tie rods.

16. The shoe press roll of claim 15, wherein each of the quick disconnect elements comprises an element which protrudes laterally from one of the side surfaces of the press shoe, and each tie rod having an extension thereon on which the protruding element from the press shoe can be suspended.

17. A shoe press roll for a press device of a paper machine, wherein the shoe press roll comprises:

a stationary support; a press jacket at the support;

a press shoe supported on the support for being pressed toward the press jacket and for pressing the press jacket toward a backing roll with which the shoe cooperates;

hydraulic elements at the support and acting on the shoe for pressing the shoe toward the backing roll, the hydraulic elements being arrayed along the length of the shoe across the web;

return means connected between the support and the press shoe for pulling the shoe away from the backing roll, the return means being positioned and arranged to act on the press shoe and on the support member outside of and not within the hydraulic elements;

lateral guide ledges on the support for guiding the shoe for taking up transverse forces on the shoe acting in the circumferential direction of the press roll; the guide ledges comprise individual guide pieces arranged spaced from each other along the length direction of the shoe, which is across the width of the web.

18. A shoe press roll for a press device of a paper machine, wherein the shoe press roll comprises:

a stationary support; a press jacket at the support;

a press shoe supported on the support for being pressed toward the press jacket and for pressing the press jacket toward a backing roll with which the shoe cooperates;

hydraulic elements at the support and acting on the shoe for pressing the shoe toward the backing roll, the hydraulic elements being arrayed along the length of the shoe across the web; the hydraulic elements comprise a pressure chamber in the support for being acted upon by hydraulic pressure and comprise a recess between the support and the press shoe;

a first sleeve in the recess laterally defining the pressure chamber, the first sleeve being axially displaceable and tiltable in the recess, along with the tilting of the press shoe with reference to the support;

return means connected between the support and the press shoe for pulling the shoe away from the backing roll, the return means being positioned and arranged to act on the press shoe and on the support member outside of and not within the hydraulic elements.

19. The shoe press roll of claim 18, further comprising pressure means acting on the displaceable first sleeve for displacing the first sleeve to move against the press shoe and with reference to the support.

20. The shoe press roll of claim 19, further comprising a second sleeve that is supported against movement in the recess, the first sleeve being axially movable and tiltable with respect to the second sleeve in the recess; and a packing between the first and second sleeves.

21. The shoe press roll at claim 20, wherein the second sleeve is radially outside the first sleeve in the recess.

22. The shoe press roll at claim 20, wherein the second sleeve is radially inside the first sleeve in the recess.

23. The shoe press roll of claim 19, wherein the pressure means comprises a compression spring in the recess and acting between the recess and the first sleeve for urging the first sleeve toward the press shoe.

* * * * *